US007980158B1

(12) United States Patent
Centrella

(10) Patent No.: US 7,980,158 B1
(45) Date of Patent: Jul. 19, 2011

(54) POLYURETHANE PRESS TOOLING COMPONENTS

(75) Inventor: John Centrella, Wharton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 379 days.

(21) Appl. No.: 12/099,968

(22) Filed: Apr. 9, 2008

Related U.S. Application Data

(60) Provisional application No. 60/912,816, filed on Apr. 19, 2007.

(51) Int. Cl.
*C06B 21/00* (2006.01)
*B30B 11/02* (2006.01)

(52) U.S. Cl. ..... 76/107.1; 72/56; 72/413; 72/415; 72/466.8; 86/23; 86/29; 86/30; 425/185; 425/193

(58) Field of Classification Search ..... 72/56, 57, 72/63, 465.1, 466.8, 413, 415; 86/23, 29, 86/30; 425/185, 193, 412, 422; 76/107.1
See application file for complete search history.

(56) References Cited

U.S. PATENT DOCUMENTS 2,395,898 A 3/1946 Mohr
2,927,499 A 3/1960 Mog et al.
3,496,818 A 2/1970 Porter et al.
3,606,637 A * 9/1971 Lawless ..... 425/406
3,702,558 A 11/1972 Swenson et al.
3,907,947 A 9/1975 Neuhaus et al.
3,986,379 A * 10/1976 Mansell ..... 72/57
4,061,453 A 12/1977 DeSantis
4,562,717 A * 1/1986 Shimizu et al. ..... 72/347
4,667,497 A * 5/1987 Oslin et al. ..... 72/62
5,205,146 A * 4/1993 Wilkins et al. ..... 72/57
5,542,282 A * 8/1996 Muldner ..... 72/389.3
5,755,130 A * 5/1998 Tung et al. ..... 72/60
5,887,475 A * 3/1999 Muldner ..... 72/379.2
6,261,082 B1 7/2001 Han
6,332,389 B1 12/2001 Han
6,354,131 B1 * 3/2002 Pirchl ..... 72/351
6,516,649 B1 2/2003 Mika et al.
6,527,535 B1 3/2003 Han
6,865,917 B2 * 3/2005 Golovashchenko et al. ..... 72/57

* cited by examiner

*Primary Examiner* — David B Jones
(74) *Attorney, Agent, or Firm* — Henry S. Goldfine

(57) ABSTRACT

A press punch for pressing a powder includes a generally cylindrical metallic body and a polyurethane layer disposed around the metallic body. The metallic body has a nominal outside diameter and a generally flat bottom face. The polyurethane layer is disposed around the metallic body such that a bottom of the polyurethane layer is flush with the generally flat bottom face of the metallic body and an outside diameter of the polyurethane layer is substantially the same as the nominal outside diameter of the metallic body. In another embodiment, the outside diameter of the polyurethane layer is greater than the nominal outside diameter of the metallic body.

17 Claims, 4 Drawing Sheets

POLYURETHANE PRESS TOOLING COMPONENTS

STATEMENT OF GOVERNMENT INTEREST

The inventions described herein may be manufactured, used and licensed by or for the U.S. Government for U.S. Government purposes.

BACKGROUND OF THE INVENTION

The invention relates in general to press tooling components and in particular to tooling components that are combinations of steel and polyurethane.

Compaction press tooling is sometimes damaged under normal operating conditions, for a variety of reasons. Compaction tooling may be particularly hazardous when high explosive (HE) powders are used in a consolidation process. Exacting tool design, installation, and alignment contribute to the prevention of inadvertent tool damage, but conditions can arise that cause eventual damage to the system. Methods of predicting and controlling the dynamic conditions (friction, thermal, fill distribution, punch velocity, and more) that lead to such events have merit for most press systems, but additional techniques are needed for HE press tooling configurations.

Tool impingement caused by radial forces that develop in the compaction zone is difficult to control. The punch cuts into the die at the point of contact, plowing a metal chip along the wall and eventually driving it into the consolidated billet. Or worse, the metal chip is forced into the punch-die clearance, galling both tools and forcing the sharp edge to impinge upon the opposite side of the die wall. The risk of damage caused by the sharp punch edge can be mitigated by a machined round with a minimal radius of 0.005 inch. However, the machined round will allow excessive flashing to extrude into the clearance zone. Excessive flash material can be hazardous under certain conditions, and leads to a process breakdown and poor quality billets.

Typically, 0.005 inch diametric clearances are required to approach optimal press performance and product quality. Closing the clearances further improves performance and quality, but tighter tooling clearances are inherently problematic. Press-equipment design tolerances generally stack up to a greater degree, allowing encroachment of the essentially free-floating press tools. Even a simple single-action punch and die press system is subject to tooling misalignment due to these tight clearances. Dual-action presses with long ram stroke are more susceptible to hazards such as scoring and galling due to the increased tool travel through the clearance zones. Increasing the clearances may prevent tool impingement and reduce associated hazards, but increased clearances create excessive flash conditions, as described previously. A solution that maintains the tight clearances needed for performance and quality, while increasing the clearances that are causal in tooling damage, is needed.

SUMMARY OF THE INVENTION

It is an object of the invention to provide press tooling that helps prevent damage to the tooling while maintain required clearances.

One aspect of the invention is a press punch comprising a generally cylindrical metallic body and a polyurethane layer disposed around the metallic body. The metallic body may have a nominal outside diameter and a generally flat bottom face. The polyurethane layer may be disposed around the metallic body such that a bottom of the polyurethane layer is flush with the generally flat bottom face of the metallic body and an outside diameter of the polyurethane layer is substantially the same as the nominal outside diameter of the metallic body.

Another aspect of the invention is a press punch comprising a generally cylindrical metallic body and a polyurethane layer disposed around the metallic body. The metallic body may have a bottom surface and a nominal outside diameter. The polyurethane layer may be disposed around the metallic body such that an outside diameter of the polyurethane layer is greater than the nominal outside diameter of the metallic body.

A further aspect of the invention is a die comprising a metallic cartridge case having internal threads at a rear portion thereof; a generally cylindrical, metallic extension case having a front section and a front end, the front section including external threads, the external threads being engaged with the internal threads of the cartridge case; and a portion of the front section, beginning with the front end and extending rearward, comprising a polyurethane layer disposed over a metallic substratum.

Yet another aspect of the invention is a method of making a die comprising providing a metallic cartridge case having internal threads at a rear portion thereof; providing a generally cylindrical, metallic extension case having a front section and a front end, the front section including external threads and a portion of the front section, beginning with the front end and extending rearward, comprising a polyurethane layer disposed over a metallic substratum, the polyurethane layer including a chamfered portion at the front end of the extension case; and threading the extension case into the cartridge case such that the chamfered portion deforms and provides a seal between an interior of the cartridge case and the internal threads of the cartridge case.

A further aspect of the invention is an apparatus comprising a die comprising a metallic cartridge case having internal threads at a rear portion thereof; a generally cylindrical, metallic extension case having a front section and a front end, the front section including external threads, the external threads being engaged with the internal threads of the cartridge case; and a portion of the front section, beginning with the front end and extending rearward, comprising a first polyurethane layer disposed over a metallic substratum; and a press punch disposed in the die and having a generally cylindrical metallic body, the metallic body having a bottom surface and a nominal diameter; and a second polyurethane layer disposed around the metallic body such that an outside diameter of the second polyurethane layer is greater than the nominal outside diameter of the metallic body.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
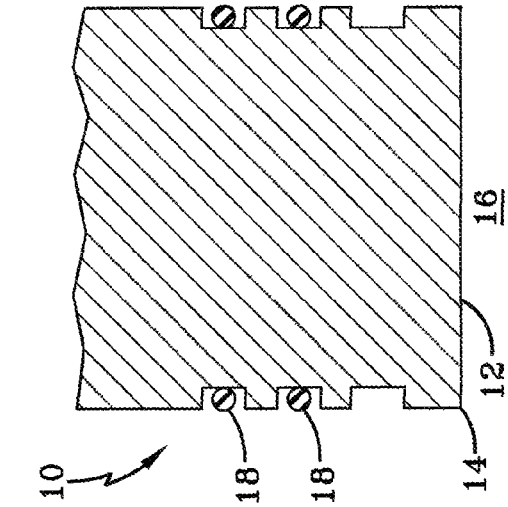
FIG-1 PRIOR ART
FIG. 1 is a cross-section of a known punch.

FIG. 1 is a cross-section of a known flat-faced press punch 10. Punch 10 is disposed above a compaction zone 16. Punch 10 may have a flat face 12 and a sharp leading edge 14. O-rings 18 may be used to seal the punch 10 against the die (not shown). The leading edge 14 is an important feature. The sharp leading edge 14 restricts flash formation and mechanically supports the billet during ejection from the die. The steel of the edge 14, which causes the damage described previously, can be effectively eliminated and replaced with a less aggressive material.

In the invention, the edge feature may be formed from a high-durometer (such as 75D, for example) polyurethane elastomer attached to the punch, combining the benefits of close (polyurethane to steel) and loose (steel to steel) clearances into a single application. The process of bonding polyurethane to metal surfaces is used for high-strength, high-durability applications.

Figure 3:
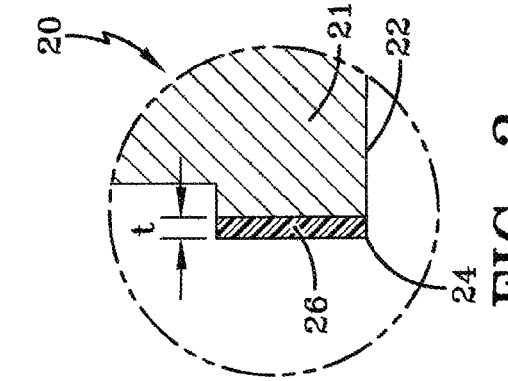
FIG. 3 is an enlarged view of a portion of FIG. 2.
Figure 2:
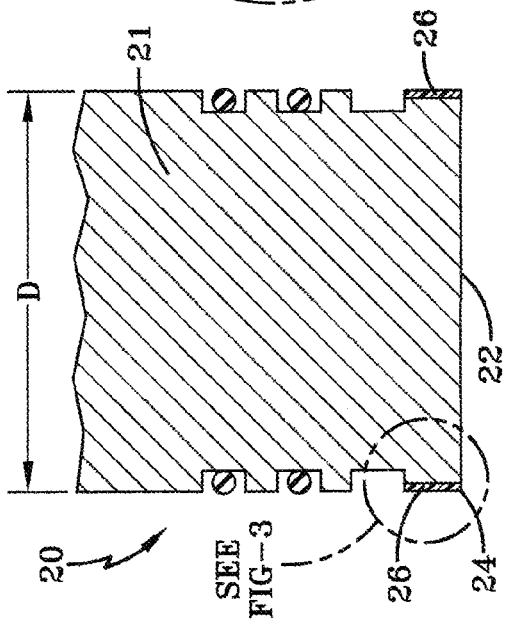
FIG. 2 is a cross-section of one embodiment of a punch in accordance with the invention.

FIG. 2 is a cross-section of one embodiment of a punch 20 in accordance with the invention. FIG. 3 is an enlarged view of a portion of FIG. 2. Punch 20 is an example of bonding polyurethane to the typical, flat-faced press punch used in pressing HE powders. Punch 20 includes a generally cylindrical, metallic body 21 with a generally flat bottom face 22 with a leading edge 24. A polyurethane layer 26 is bonded to the metallic body 21. The polyurethane layer 26 replaces the steel punch edge and serves as a mechanism to locate and guide the moving punch 20 along the central die axis. In the embodiment of FIG. 2, the layer 26 is generally ring-shaped.

If the punch 20 is forced to encroach into the clearance zone and impinge upon the die wall, the polyurethane layer 26 is strong enough to resist the off-axis movement and prevent tooling damage. The sharp edge is maintained by the polyurethane layer 26. Close clearances are achieved while steel-against-steel clearances are opened to safe distances. The polyurethane layer 26 preserves the punch geometry while working as a passive guidance bumper.

In the embodiment of FIG. 2, the nominal outside diameter D of the punch 20 is not increased by addition of the layer 26. That is, sufficient steel is removed from punch 20 by, for example, machining, to thereby create a reduced diameter portion for layer 26. An exemplary thickness t of layer 26 may be in the range of about 0.010 inches to about 0.050 inches. In addition, the bottom of layer 26 is flush with the face 22 of the punch 20.

Prior to applying layer 26, punch 20 is machined at the area where the layer 26 will be applied. The polyurethane material is cast on to the punch 20 using, for example, molds and vacuum conditioning. Once cured, the bond between the polyurethane layer 26 and the metal substratum is permanent. The bond is stronger in shear strength than the polyurethane itself. There is no gap or glue-joint that will accumulate pressed materials under high pressures. The gross cast provides enough working material to create the finished polyurethane layer 26 to design specifications.

Figure 5:
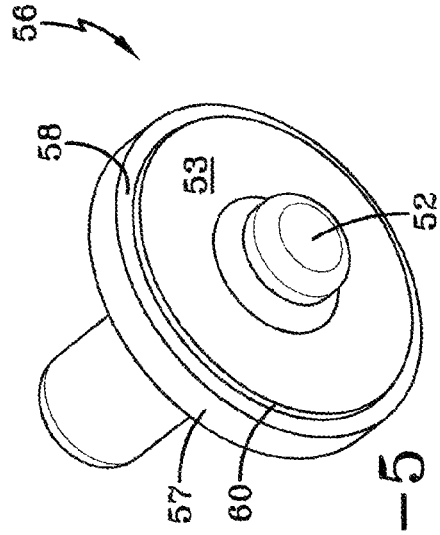
FIG. 5 is a perspective view of a second embodiment of a punch in accordance with the invention.
Figure 4:
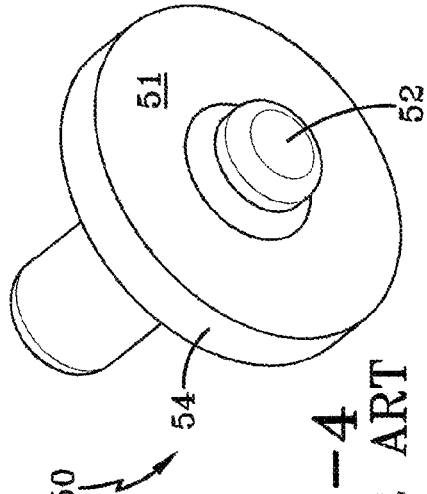
FIG-4 PRIOR ART
FIG. 4 is perspective view of a known punch.

FIG. 4 is perspective view of another known punch 50. Punch 50 may have a protrusion 52 on the bottom face 51. Punch 50 includes a generally cylindrical, metallic (for example, steel) body 54. FIG. 5 is a perspective view of a second embodiment of a punch 56 in accordance with the invention. Punch 56 includes a generally cylindrical, metallic (for example, steel) body 57. Punch 56 may have a protrusion 52 on the bottom face 53. Punch 56 is similar to punch 50 except that an annular ring of metal is removed from the lower body thereby creating a step 58 and a reduced diameter portion 60.

Figure 7:
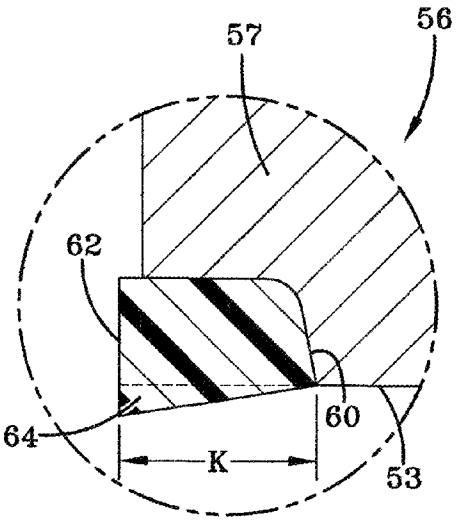
FIG. 7 is an enlarged view of a portion of FIG. 6.
Figure 6:
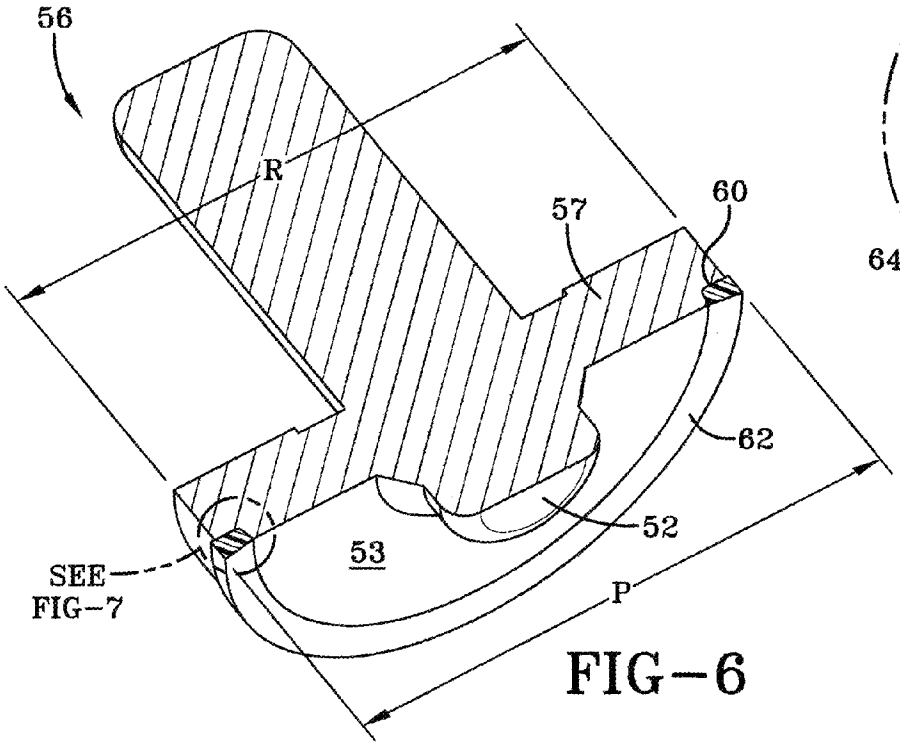
FIG. 6 is a sectional perspective view of the second embodiment of the punch.

As seen in FIGS. 6 and 7, a polyurethane layer 62, generally annular or ring-shaped, is bonded to the reduced diameter portion 60. Layer 62 may have an outside diameter P that exceeds the nominal outside diameter R of the punch body 57. In addition, a portion 64 (below the dotted line of FIG. 7) of the polyurethane layer 62 extends below the bottom surface 53 of the body 57 and tapers radially inward to the bottom surface 53. A radial thickness K of the polyurethane layer 62 is in the range of about 0.010 inches to about 0.050 inches.

Figure 8:
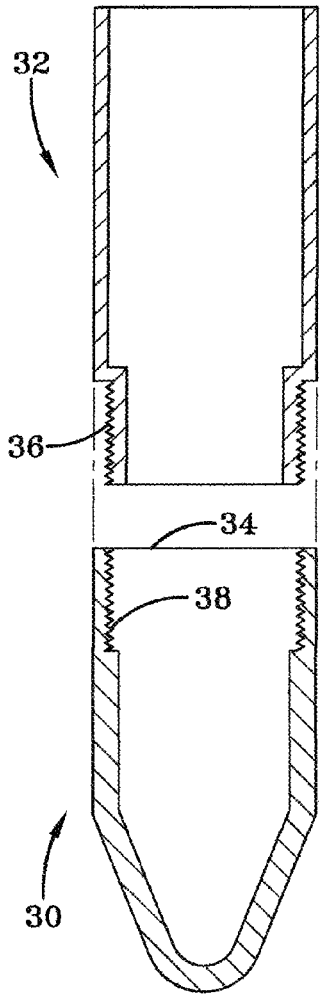
FIG-8 PRIOR ART
FIG. 8 is a sectional view of a known cartridge case and extension case.

Punch 56 may be used when press-loading a warhead. When press-loading some warheads, such as a 120 mm warhead, the mass and density of the explosive make a one-stroke process problematic. That is, the warhead case volume is too small to contain the full load of uncompressed explosive powder. Referring to FIG. 8, a metallic cartridge case 30 may be extended by attaching a metallic extension case 32 to the back end 34 of the case 30. The cartridge case 30 and the extension case 32 may be joined by threading external threads 36 on the extension case 32 into the internal case-closure threads 38 at the rear of the cartridge case 30. The combination of the cartridge case 30 and the extension case 32 is the die into which the explosive powder is loaded for consolidation.

Figure 9:
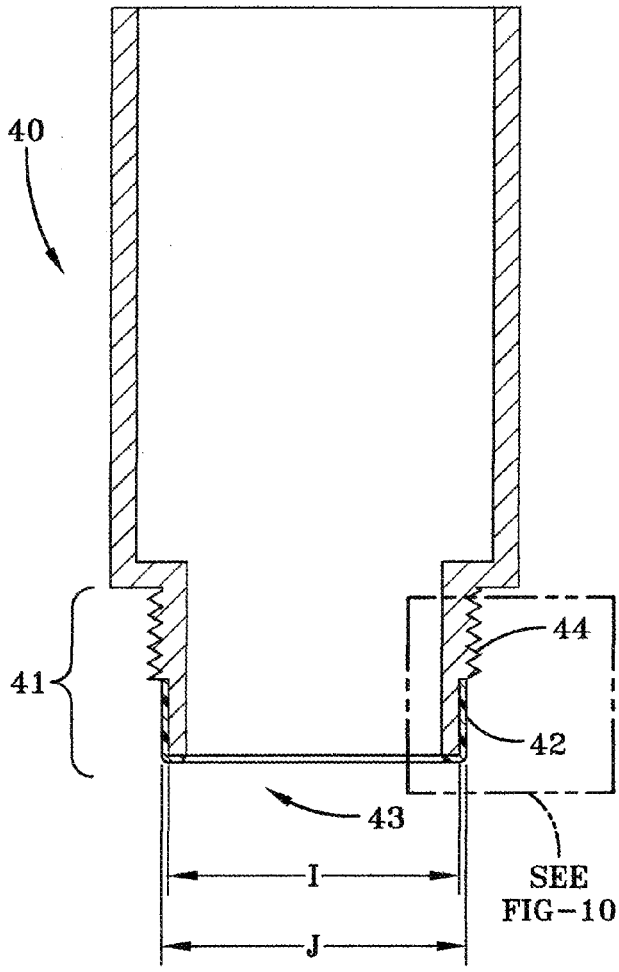
FIG. 9 is a sectional view of a metal and polyurethane extension case.

Extension case 32 is made of metal, for example, steel, and includes metallic external threads 36. In the invention, case 32 is modified so that a portion of the threads 36 are replaced with a polyurethane layer. FIG. 9 is a sectional view of a generally cylindrical extension case 40 with polyurethane layer 42. Extension case 40 includes a front section 41 with a front end 43. The front section 41 includes metallic external threads 44 for mating with the internal threads 38 of the cartridge case 30. A portion of the front section 41, beginning with the front end 43 and extending rearward, comprises a polyurethane layer 42 disposed over the metallic substratum.

The metallic substratum has a diameter I that is less than a nominal diameter J of the front section 41 of the metallic extension case 40. The polyurethane layer 42 is bonded to the underlying metallic substratum of the case 40. Preferably, the exterior surface of the polyurethane layer 42 has a smooth finish. However, all or part of the polyurethane layer 42 may be externally threaded to mate with the threads 38 of the cartridge case 30.

Figure 10:
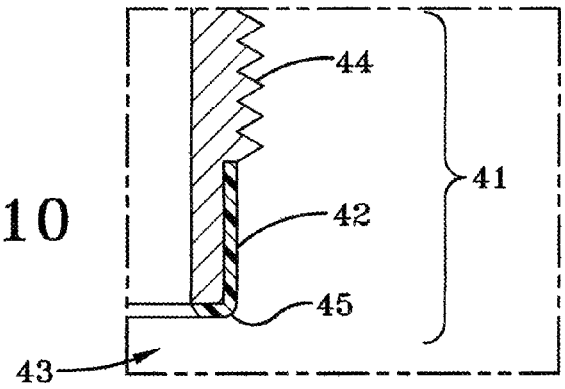
FIG. 10 is an enlarged view of a portion of FIG. 9.
Figure 11:
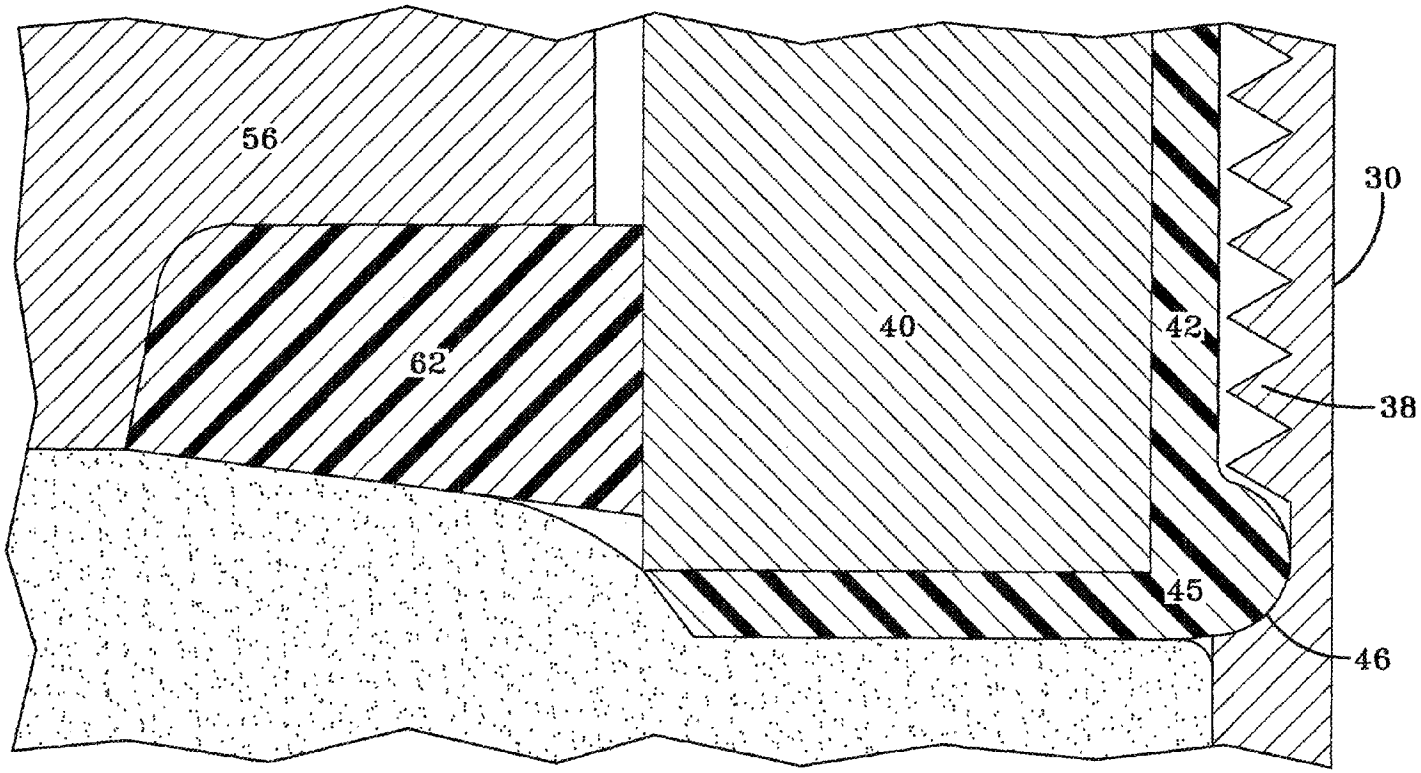
FIG. 11 is an enlarged view showing the relationship between the punch, extension case and cartridge case.

As best seen in FIG. 10, the polyurethane layer 42 includes a chamfered or beveled portion 45 at the front end 43 of the extension case 40. When the extension case 40 is threaded into the cartridge case 30, the extension case 40 will reach the end of threads 38 in the cartridge case 30 and the chamfered portion 45 will deform as the extension case 40 is tightened into the cartridge case 30. The deformed chamfered portion 45 provides a polyurethane seal between the interior of the case 30 and the threads 38 of the case 30. FIG. 11 is a greatly enlarged view showing the seal provided by chamfered portion 45 between the powder in the case 30 and the case threads 38. Also shown in FIG. 11 is the punch 56 with polyurethane layer 62.

The polyurethane seal formed by chamfer portion 45 eliminates the extrusion of pressed explosive powder into the case-closure thread zone. The chamfered portion 45 seats onto the shoulder 46 inside the warhead case 30. As the cases 30 and 40 are threaded tight, the chamfered portion 45 is compressed against the edge of the shoulder 46, positively sealing off the threads 38 from any migrating flash.

Referring now to the punch 56, by way of example, the outside diameter P (FIG. 6) of the polyurethane layer 62 on punch 56 may allow for 0.005 in. of wall clearance with case 30 while the outside diameter R (FIG. 6) of the punch body 57 may allow for 0.026 in. wall clearance with the case 30. The polyurethane layer 62 accomplishes both the close clearance for process efficiency and quality and the open steel-to-steel clearances to prevent tooling damage and mitigate hazards. In trials using an inert consolidation powder, the punch 56 effectively sealed off the consolidation zone and completely eliminated the migration of flash, as typically found on a pressing punch. The inert powder was pressed using 20 kpsi, 140 degrees Fahrenheit, and 200 mTorr of vacuum pressure.

The punch 56 pulled away cleanly from the pressed warhead fill without tearing the surface. The polyurethane layer 62 was found to be slightly roughened by shallow indentations of the countless grains of powder. In a few moments the layer 62 was restored to normal smooth surface. The leading edge of the layer 62 remained sharp after the pressing process. The pressing punch 56 performed well through multiple inert pressing trials using a range of parameters normally used in pressing PAX-3A, and other HE powders.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A press punch, comprising:

a generally cylindrical metallic body; and a polyurethane layer disposed around the metallic body wherein the polyurethane layer comprises a high durometer polyurethane and the polyurethane layer being disposed in a reduced diameter portion and the metallic body has a nominal outside diameter and a generally flat bottom face and further wherein the polyurethane layer is disposed around the metallic body such that a bottom of the polyurethane layer is flush with the generally flat bottom face of the metallic body and an outside diameter of the polyurethane layer is substantially the same as the nominal outside diameter of the metallic body and the polyurethane layer has a thickness in the range of about 0.010 inches to about 0.050 inches.

2. The punch of claim 1 wherein the metallic body comprises a reduced diameter portion, the polyurethane layer being disposed in the reduced diameter portion.

3. The punch of claim 1 wherein the polyurethane layer is generally ring-shaped.

4. The punch of claim 1 wherein the polyurethane layer is disposed around the metallic body such that an outside diameter of the polyurethane layer is greater than the nominal outside diameter of the metallic body.

5. The punch of claim 4 wherein a portion of the polyurethane layer extends below the bottom surface of the body and tapers radially inward to the bottom surface.

6. The punch of claim 4 wherein the polyurethane layer comprises a high durometer polyurethane.

7. The punch of claim 4 wherein the metallic body comprises a reduced diameter portion, the polyurethane layer being disposed in the reduced diameter portion.

8. The punch of claim 4 wherein the polyurethane layer is generally ring-shaped.

9. A press punch, comprising:

a generally cylindrical metallic body; and a polyurethane layer disposed around the metallic body wherein the metallic body has a nominal outside diameter and a generally flat bottom face and further wherein the polyurethane layer is disposed around the metallic body such that a bottom of the polyurethane layer is flush with the generally flat bottom face of the metallic body and an outside diameter of the polyurethane layer is substantially the same as the nominal outside diameter of the metallic body and wherein a thickness of the polyurethane layer is in the range of about 0.010 inches to about 0.050 inches.

10. A die, comprising:

a metallic cartridge case having internal threads at a rear portion thereof;

a generally cylindrical, metallic extension case having a front section and a front end, the front section including external threads, the external threads being engaged with the internal threads of the cartridge case; and a portion of the front section, beginning with the front end and extending rearward, comprising a polyurethane layer disposed over a metallic substratum.

11. The die of claim 10 wherein the metallic substratum has a diameter that is less than a nominal diameter of the front section of the metallic extension case.

12. The die of claim 11 wherein the polyurethane layer includes a chamfered portion at the front end of the extension case and further wherein the chamfered portion is deformed when the extension case is seated in the cartridge case to thereby provide a polyurethane seal between an interior of the die and the internal threads of the cartridge case.

13. The die of claim 10 wherein a portion of the external threads are formed in the polyurethane layer.

14. A method of making a die, comprising:

providing a metallic cartridge case having internal threads at a rear portion thereof;

providing a generally cylindrical, metallic extension case having a front section and a front end, the front section including external threads and a portion of the front section, beginning with the front end and extending rearward, comprising a polyurethane layer disposed over a metallic substratum, the polyurethane layer including a chamfered portion at the front end of the extension case; and threading the extension case into the cartridge case such that the chamfered portion deforms and provides a seal between an interior of the cartridge case and the internal threads of the cartridge case.

15. An apparatus, comprising:

a die comprising a metallic cartridge case having internal threads at a rear portion thereof; a generally cylindrical, metallic extension case having a front section and a front end, the front section including external threads, the external threads being engaged with the internal threads of the cartridge case; and a portion of the front section, beginning with the front end and extending rearward, comprising a first polyurethane layer disposed over a metallic substratum; and a press punch disposed in the die and having a generally cylindrical metallic body, the metallic body having a bottom surface and a nominal diameter; and a second polyurethane layer disposed around the metallic body such that an outside diameter of the second polyurethane layer is greater than the nominal outside diameter of the metallic body.

16. The apparatus of claim 15 wherein a portion of the second polyurethane layer extends below the bottom surface of the body and tapers radially inward to the bottom surface.

17. The apparatus of claim 16 wherein the first polyurethane layer includes a chamfered portion at the front end of the extension case and further wherein the chamfered portion is deformed when the extension case is seated in the cartridge case to thereby provide a polyurethane seal between an interior of the die and the internal threads of the cartridge case.

* * * * *